US007566226B2

(12) United States Patent
Roemer et al.

(10) Patent No.: US 7,566,226 B2
(45) Date of Patent: Jul. 28, 2009

(54) ADJUSTABLE TERMINAL BLOCK

(75) Inventors: Daniel Frank Roemer, Oregon, WI (US); Brad Michael Diedrich, Monroe, WI (US); Chad A. Kautz, Winslow, IL (US); Jason A Planck, Monroe, WI (US)

(73) Assignee: Mitek Corp., Inc., Monroe, WI (US)

( * ) Notice: Subject to any disclaimer, the term of this patent is extended or adjusted under 35 U.S.C. 154(b) by 197 days.

(21) Appl. No.: 11/745,786

(22) Filed: May 8, 2007

(65) Prior Publication Data

US 2008/0280501 A1 Nov. 13, 2008

(51) Int. Cl.
*H01R 24/00* (2006.01)

(52) U.S. Cl. ..... 439/49; 200/16 R

(58) Field of Classification Search ..... 439/49, 439/189; 200/5 R, 16 R, 16 A, 16 D; 381/81, 381/123, 401

See application file for complete search history.

(56) References Cited

U.S. PATENT DOCUMENTS 1,393,822 A * 10/1921 Parker ..... 439/189
3,262,088 A * 7/1966 West ..... 439/849
4,029,917 A * 6/1977 Webster ..... 200/5 R
4,725,698 A * 2/1988 Takai et al. ..... 200/50.29
6,656,000 B2 12/2003 Abdo
6,933,452 B2 * 8/2005 Liu ..... 200/51 R
7,194,104 B2 * 3/2007 Sahyoun ..... 381/401
7,410,361 B2 * 8/2008 Sumitani et al. ..... 439/49
7,458,845 B2 * 12/2008 Sumitani et al. ..... 439/507

* cited by examiner

*Primary Examiner*—Neil Abrams
(74) *Attorney, Agent, or Firm*—Keith L. Jenkins

(57) ABSTRACT

An adjustable terminal is disclosed having a plurality of electrical contacts electrically coupled between a corresponding number of pair-wise electrically-coupled input terminals and output terminals. A plurality of mechanically coupled jumpers are operable to pair-wise jump the electrical contacts to reconfigure the adjustable terminal variously for bi-amplifier output, parallel output, and series output at said output terminals. A housing is disclosed having support for the electrical contacts and for the jumpers, as well as labels for inputs, outputs, and current configuration. The jumpers may be mounted to a slider card that is movable between three positions to provide terminal reconfiguration.

20 Claims, 4 Drawing Sheets

ADJUSTABLE TERMINAL BLOCK

FIELD OF THE INVENTION

The present invention relates generally to an adjustable terminal having up to four inputs connectable to up to four outputs in various configurations. More specifically, the present invention relates to an adjustable terminal between two speakers and one or two amplifiers supplying one or two audio signals to those speakers.

BACKGROUND OF THE INVENTION

Connecting automotive audio amplifiers to automotive car audio speakers presents various configuration options. For example, multiple speakers may be hooked up to a single amplifier. One popular configuration of amplifiers and speakers, known as a "bi-amplifier" configuration, uses one amplifier for the woofer and another amplifier for the mid-range speaker and the tweeter. Alternatively, those same two speakers may be connected in series to one amplifier, or the two speakers may be connected to one amplifier in parallel. Different configurations require different wiring at installation. Each particular configuration has required a terminal block designed for making the particular respective connections, thereby requiring that a variety of terminal blocks be manufactured and kept in stock. This results in unwanted expense in maintaining a varied stock of terminal blocks.

Modern automotive sound systems may include large installations (i.e., woofers weighing over 300 pounds) in an environment in which space is a problem. Accordingly, the size of a terminal block is a factor in design. With a varied stock of terminal blocks, some blocks may fit in particular installations, and others, though needed, may not.

During installation, conventional terminal blocks may be inadvertently mis-wired because each input and each output may not be clearly indicated. The result of mis-wiring may be poor audio performance or damage to the audio system.

Hence, there is a need for a single terminal block that can be easily reconfigured to meet various audio wiring requirements. The adjustable terminal block preferably combines small size, ease of operation, economy of manufacture, and utility in multiple amplifier-to-speaker configurations. The present invention addresses these needs.

BRIEF SUMMARY OF THE INVENTION

One embodiment of the present invention provides an adjustable terminal block operable for connecting two speakers to two amplifiers in a bi-amplifier configuration, or to connect one amplifier to two speakers in parallel, or to connect one amplifier to two speakers in series. The adjustable terminal block has a small form factor and is operated by changing the position of a slider switch. Wiring terminals and switch positions are clearly labeled.

BRIEF DESCRIPTION OF THE DRAWINGS

The above and other objects and advantages of the present invention will become more apparent from the following description taken in conjunction with the following drawings in which.

DETAILED DESCRIPTION OF THE DRAWINGS

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Figure 1A:
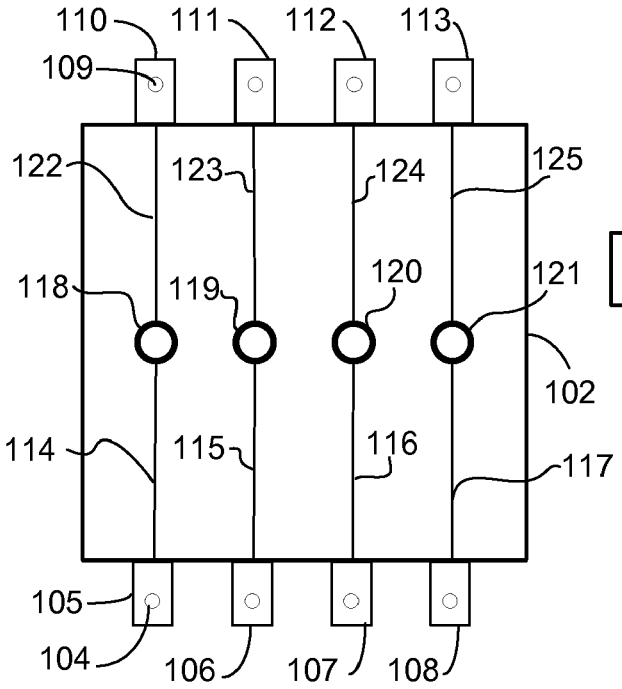
FIG. 1A is a top plan view illustrating a terminal base used in an exemplary embodiment of an adjustable terminal block.

FIG. 1A is a top plan view illustrating a terminal base 102 used in an exemplary embodiment of an adjustable terminal block 200 (see FIG. 2). Terminal base 102 is preferably a circuit board having four input terminals 105, 106, 107, and 108; four corresponding output terminals 110, 111, 112, and 113; and four corresponding electrical contacts 118, 119, 120, and 121 located between respective input terminals 105-108 and respective output terminals 110-113, as shown. Input terminals 105-108 are preferably electrically coupled to respective electrical contacts 118-121 by respective input conductors 114, 115, 116, and 117, as shown. Electrical contacts 118-121 are preferably electrically coupled to respective output terminals 110-113 by respective output conductors 122, 123, 124, and 125, as shown. Upon reading the teachings of this specification, those with ordinary skill in the art will now understand that, under appropriate circumstances, considering such issues as advances in technology, user preference, material costs, etc., a larger number of input terminals 105-108, input conductors 114-117, electrical contacts 118-121, output conductors 122-125, output terminals 110-113, other materials for the terminal base 102, and various approaches to electrical coupling, etc., may suffice.

Input terminals 105-108 have securing devices for securing an electrical conductors from one or more amplifier (not shown) to the input terminals 105-108. For example, input terminal 105 is illustrated as having a setscrew hole 104 for receiving a setscrew for securing a conductor to input terminal 105. Likewise, output terminal 110 is illustrated as having a setscrew hole 109 for receiving a setscrew for securing a conductor to output terminal 110. Those of skill in the art will be aware of the various designs of input terminals 105-108 that may be used to electrically couple external electrical conductors (not shown) to input conductors 114-117 and, similarly, to couple external electrical conductors to output conductors 122-125. Input conductors 114-117 and output conductors 122-125 are preferably plated onto the terminal base 102 but may be discrete wires. Electrical contacts 118-121 are illustrated as conductive protrusions, but the present invention is not so limited, as will be discussed further below. Terminal base 102 preferably has adaptations to receive mechanical couplings to assist in securing the terminal base 102 to a housing 400 (see FIG. 4A), as will be discussed further below. Upon reading the teachings of this specification, those with ordinary skill in the art will now understand that, under appropriate circumstances, considering such issues as advances in technology, user preference, material costs, etc., various types of input terminals 105-108 and output terminals 110-113 and various approaches to mechanically coupling the terminal base 102 to a housing, etc., may suffice.

Figure 1B:
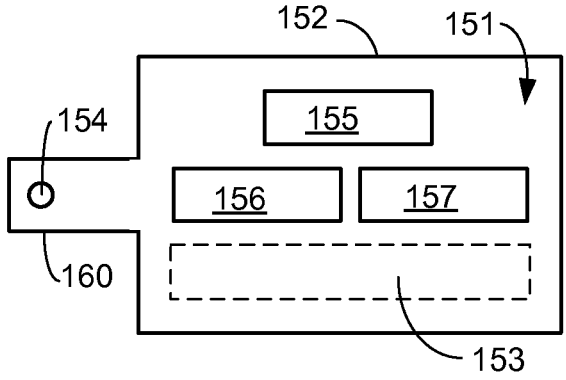
FIG. 1B is a top plan view illustrating a slider card used with the terminal base of FIG. 1A in an exemplary embodiment of an adjustable terminal block.

FIG. 1B is a top plan view illustrating a slider card 152 used with the terminal base 102 of FIG. 1A in an exemplary embodiment of an adjustable terminal block 200 (See FIG. 2). Slider card 152 is preferably made of a rigid material that is a good electrical insulator. Circuit board material is preferred for slider card 152, but other insulators will do. Slider card has a tab 160 with a hole 154 for receiving a fastener to fasten the slider card 152 in one of three particular positions, as will be seen in more detail below. Slider card 152 mechanically couples three electrically conductive jumpers 155, 156, and 157. The mechanically coupled jumpers 155-157 are shown in outline on the top surface 151 of slider card 152, but actually extend from the bottom surface of slider card 152. A space 153 on the slider card below jumpers 155-157 contains no jumpers. Space 153, when aligned with electrical contacts 118-121 on terminal base 102 provides no jumping of the electrical contacts 118-121. Jumper 156 is operable, when aligned with electrical contacts 118-121, to provide a first electrically conductive path between electrical contacts 118 and 119. When jumper 156 is aligned with electrical contacts 118 and 119, jumper 157 concurrently creates a second electrically conductive path between electrical contacts 120 and 121. Jumper 155 is operable, when aligned with electrical contacts 119 and 120, to provide an electrically conductive path between electrical contacts 119 and 120. Accordingly, slider card 152 provides three options for circuit configuration: no jumping; jumping electrical contact 118 to electrical contact 119 and jumping electrical contact 120 to electrical contact 121; or jumping electrical contact 119 to electrical contact 120. The illustrated embodiments of terminal base 102 and slider card 152 emphasize simplicity of design. In alternate embodiments, the electrical contacts 118-121 may not be positioned in a straight line and the orientation and shape of the mechanically coupled jumpers 155-157 may be adapted to achieve the same electrical result with various patterns of electrical contacts 118-121, mechanically coupled jumpers 155-157, and space 153. Upon reading the teachings of this specification, those with ordinary skill in the art will now understand that, under appropriate circumstances, considering such issues as advances in technology, user preference, material costs, etc., various arrangements of electrical contacts 118-121, more electrical contacts 118-121, corresponding sizes, shapes, and numbers of jumpers 155-157, rotational motion of the slider card 152 adapted to a radial arrangement of electrical contacts 118-121, etc., may suffice.

Figure 2A:
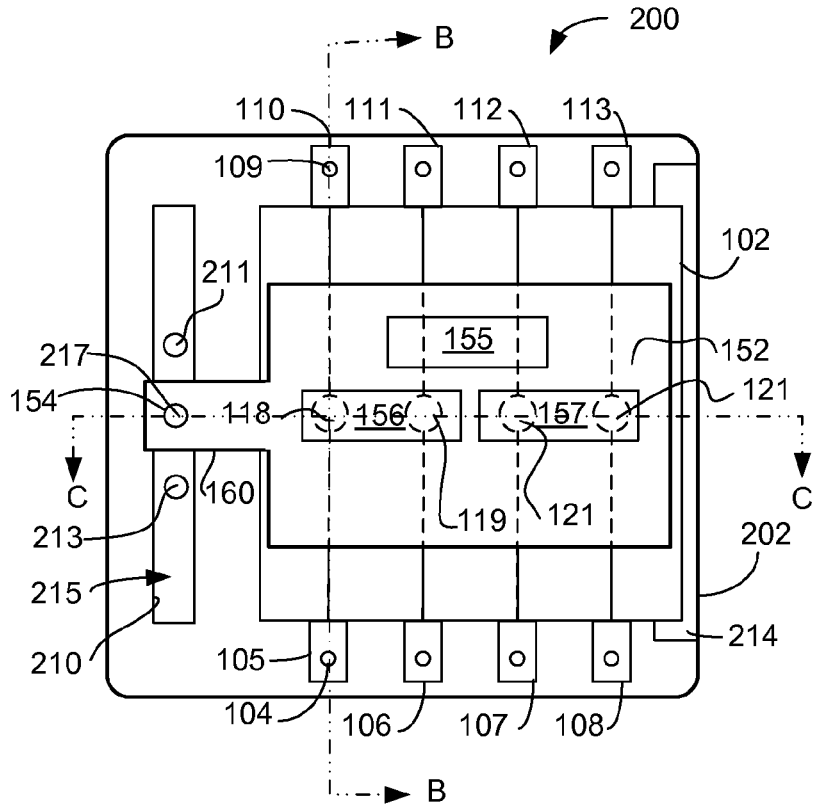
FIG. 2A is a top plan x-ray view illustrating an exemplary embodiment of the adjustable terminal block including the terminal base of FIG. 1A and the slider card of FIG. 1B, further showing cross-sections BB and CC.

FIG. 2A is a top plan x-ray view illustrating an exemplary embodiment of the adjustable terminal block 200 including the terminal base 102 of FIG. 1A and the slider card 152 of FIG. 1B, further showing cross-sections BB and CC. Slider card 152 is shown in the second position, with jumpers 156 and 157 providing electrically conductive paths between electrical contacts 118 and 119 and between electrical contacts 120 and 121, respectively. Housing perimeter 202 surrounds terminal base 102 and slider card 152. In operation, slider card 152 may be positioned in a first position providing no jumping; a second position for jumping electrical contacts 118 and 119 while also jumping electrical contacts 120 and 121; or a third position for jumping electrical contacts 119 and 120. Tab support 210 provides a top surface 215 upon which tab 160 of slider card 152 is supported when at rest or when sliding to a new position. Tab support 210 has fastening adaptations 211, 217, and 213 (illustrated as threaded bores) for receiving a fastener. Fastening adaptations 211, 217, and 213 allow slider card 152 to be fastened into position by extending a fastener through hole 154 and into one of fastening adaptations 211, 217, and 213. Tab support 210 and terminal base 102 are preferably coupled to interior surfaces of a housing 400 (See FIG. 4). Slider support 214 provides support for the slider card 152 distal to the tab 160. Slider support 214 is preferably coupled to the same housing 400 (See FIG. 4) as the tab support 210 and the terminal base 102. Upon reading the teachings of this specification, those with ordinary skill in the art will now understand that, under appropriate circumstances, considering such issues as advances in technology, user preference, material costs, etc., various types and configurations of fastening adaptations 211, 217, and 213 and corresponding fasteners, various sizes and shapes of tab 160, various approaches to the design of tab support 210 and slider support 214, etc., may suffice.

Figure 2B:
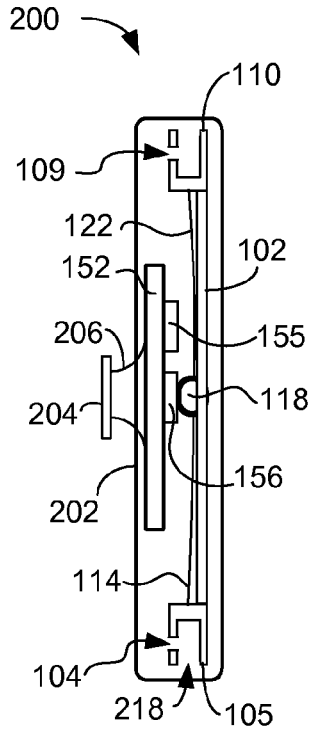
FIG. 2B is a cross-sectional view through cross section BB of FIG. 2A illustrating an exemplary embodiment of an adjustable terminal block.

FIG. 2B is a cross sectional view through cross section BB of FIG. 2A illustrating an exemplary embodiment of an adjustable terminal block 200. Support 206 extends from slider card 152 to slider handle 204. Slider handle 204 may be manually operated to reposition slider card 152 relative to terminal base 102 and electrical contacts 118-121. Slider handle 204 is preferably of ergonomic design for ease of use. Jumper 156 is shown extending below slider card 152 to make physical and electrical contact with electrical contact 118, which extends from terminal base 102. In other embodiments, other designs of electrical contacts 118-121 and jumpers 155-157 may be employed. For example, and without limitation, electrical contact 118 may include a pair of opposed leaf springs and jumper 156 may include a downward extending pin operable to slide between the opposed leaf springs to make electrical contact. In a further refinement of such an alternate embodiment, the leaf springs may have opposing détentes shaped to receive the pin, so that the manual operator of the slider card 152 can feel a "click" when the pin is in place. Input terminal 105 is shown with cavity 218 for receiving an external electrical conductor and setscrew hole 104 for receiving a setscrew that secures the external electrical conductor to the input terminal 105. Input conductor 114 is illustrated as a wire for visibility in this view, although plated-on input conductors 114-117 are preferred. Output conductor 122 is illustrated as a wire for visibility in this view, although plated-on output conductors 122-125 are preferred. Upon reading the teachings of this specification, those with ordinary skill in the art will now understand that, under appropriate circumstances, considering such issues as advances in technology, user preference, material costs, ergonomics, etc., various designs for electrical contacts 118-121 and corresponding jumpers 155-157, various designs for cavity 218, and various ergonomic sizes and shapes for slider handle 204, etc., may suffice.

Figure 2C:
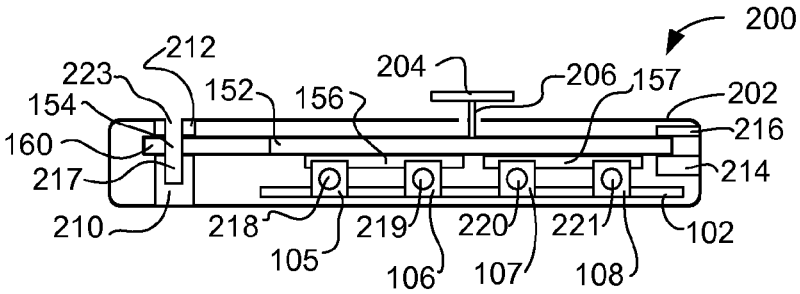
FIG. 2C is a cross-sectional view through cross section CC of FIG. 2A illustrating the exemplary embodiment of the adjustable terminal block of FIG. 2A.

FIG. 2C is a cross-sectional view through cross section CC of FIG. 2A illustrating the exemplary embodiment of the adjustable terminal block 200 of FIG. 2A. Tab constraint 212 urges the tab 160 against the top surface 215 of tab support 210 and assists in constraining the slider card 152 against partial rotational motion and resulting misalignment. Tab constraint 212 has openings corresponding to fastening adaptations 211, 217, and 213 in location, size, and shape. One such opening 223 is illustrated in alignment with hole 154 in tab 160 and fastening adaptation 217 in tab support 210 to receive a fastener. Slider constraint 216 urges a distal edge portion of slider card 152 against slider support 214 and assists in constraining the slider card 152 against rotational motion. Cavities 218, 219, 220, and 221 in respective input terminals 105-108 receive external electrical conductors into input terminals 105-108, respectively, and electrically signals on the external electrical conductors to the input conductors 114-117, respectively. Upon reading the teachings of this specification, those with ordinary skill in the art will now understand that, under appropriate circumstances, considering such issues as advances in technology, user preference, material costs, ergonomics, etc., various approaches to aligning electrical contacts 118-121 to fastener adaptations 211, 213, and 217, use of multi-plane circuit boards, etc., may suffice.

Figure 3C:
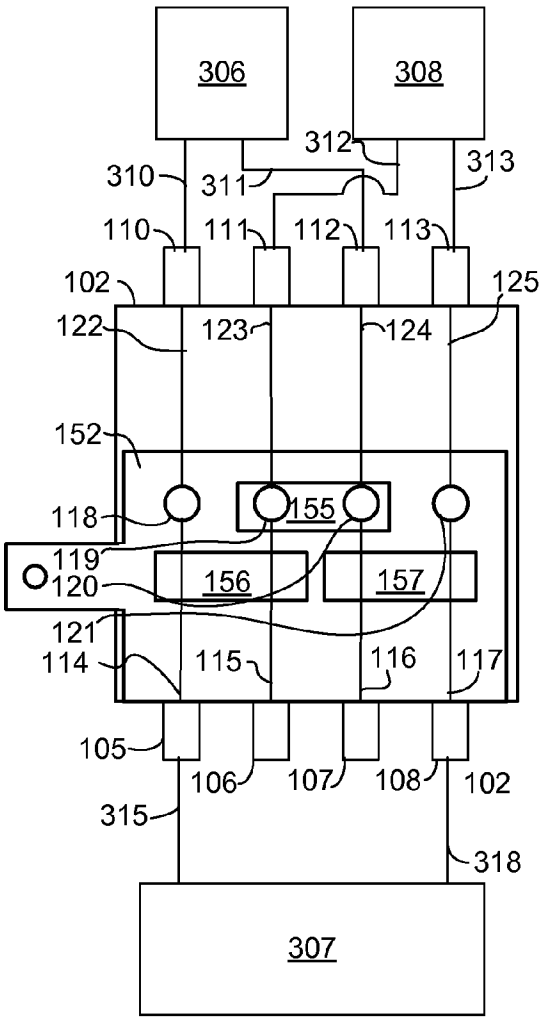
FIG. 3C is an electrical diagrammatic view illustrating the exemplary embodiment of the adjustable terminal block of FIGS. 2A-2C in a series configuration.
Figure 3B:
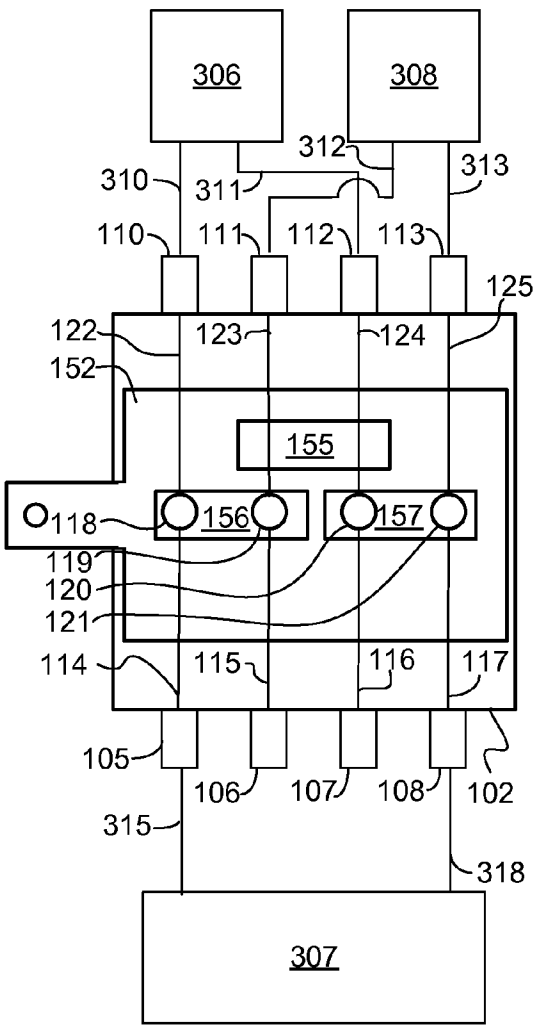
FIG. 3B is an electrical diagrammatic view illustrating the exemplary embodiment of the adjustable terminal block of FIGS. 2A-2C in a parallel configuration.
Figure 3A:
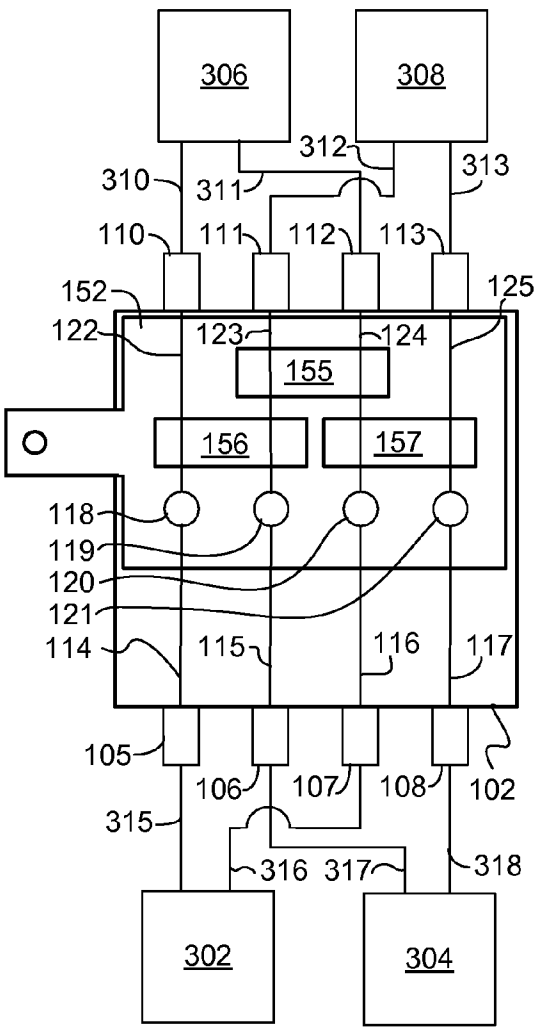
FIG. 3A is an electrical diagrammatic view illustrating the exemplary embodiment of the adjustable terminal block of FIGS. 2A-2C in a bi-amplifier configuration.

FIG. 3A is an electrical diagrammatic view illustrating the exemplary embodiment of the adjustable terminal block 200 of FIGS. 2A to 2C in a bi-amplifier configuration. Slider card 152 (illustrated as transparent) is in a first position in which none of the mechanically coupled jumpers 155-157 are in electrical contact with any of the electrical contacts 118-121. Accordingly, the circuit has a one-to-one correspondence in electrical connectivity between input terminals 105-108 and output terminals 110-113. First amplifier 302 is configured with its negative {VC1(−)} lead 315 connected to input terminal 105 and with its positive {VC1(+)} lead 316 connected to input terminal 107. First speaker 306 is configured with its negative lead 310 connected to output terminal 110 and with its positive lead 311 connected to output terminal 112. Input terminal 105 is connected to output terminal 110 via input conductor 114, electrical contact 118, and output conductor 122. Input terminal 107 is connected to output terminal 112 via input conductor 116, electrical contact 120, and output conductor 124. Thus, first speaker 306 is driven exclusively by first amplifier 302. Second amplifier 304 (a signal source) is configured with its negative {VC1(−)} lead 317 connected to input terminal 106 and with its positive {VC1(+)} lead 318 connected to input terminal 108. Second speaker 308 (a signal receiver) is configured with its negative {VC2(−)} lead 312 to output terminal 111 and with its positive {VC2(+)} lead 313 connected to output terminal 113. Input terminal 106 is connected to output terminal 111 via input conductor 115, electrical contact 119, and output conductor 123. Input terminal 108 is connected to output terminal 113 via input conductor 117, electrical contact 121, and output conductor 125. Thus, second speaker 308 is driven exclusively by second amplifier 304. Upon reading the teachings of this specification, those with ordinary skill in the art will now understand that, under appropriate circumstances, considering such issues as advances in technology, user preference, material costs, ergonomics, etc., a larger number of speakers 306 and 308 and amplifiers 302 and 304, inclusion of impedance-matching circuit elements to input conductors 114-117 or output conductors 122-125, or adaptations for other loads (such as light organs), etc., may suffice.

FIG. 3B is an electrical diagrammatic view illustrating the exemplary embodiment of the adjustable terminal block 200 of FIGS. 2A-2C in a parallel configuration. Amplifier 307 is configured its negative {VC1(−)} lead 315 connected to input terminal 105 and with its positive {VC1(+)} lead 318 connected to input terminal 108. Slider card 152 is in the second position, in which jumper 156 connects electrical contact 118 to electrical contact 119 and jumper 157 connects electrical contact 120 to electrical contact 121. The amplifier 307 output signal at input terminal 105 is supplied to output terminals 110 and 111. Output terminal 110 is supplied via input conductor 114, electrical contact 118, and output conductor 122. Output terminal 111 is supplied via input conductor 114, electrical contact 118, jumper 156, electrical contact 119, and output conductor 123. The signal at input terminal 105 is, therefore, supplied to first speaker 306 along negative lead 310 and to second speaker 308 along negative lead 312. The amplifier output signal at input terminal 108 is present at output terminals 112 and 113. Output terminal 112 is supplied via input conductor 117, electrical contact 121, jumper 157, electrical contact 120, and output conductor 124. Output terminal 113 is supplied via input conductor 117, electrical contact 121, and output conductor 125. The signal at input terminal 108 is, therefore, supplied to first speaker 306 along positive lead 311 and to second speaker 308 along positive lead 313. In this configuration, one amplifier 307 drives two speakers in parallel. Input terminals 106 and 107 are not used in this configuration. Upon reading the teachings of this specification, those with ordinary skill in the art will now understand that, under appropriate circumstances, considering such issues as advances in technology, user preference, material costs, needs for a circuit, etc., reverse operation using two supply circuits in parallel driving a single load, additional similar circuitry to accommodate additional speakers 306 and 308, additional similar circuitry to accommodate additional amplifiers, etc., may suffice.

FIG. 3C is an electrical diagrammatic view illustrating the exemplary embodiment of the adjustable terminal block 200 of FIGS. 2A-2C in a series configuration. Amplifier 307 is configured with its negative {VC1(−)} lead 315 connected to input terminal 105 and with its positive {VC1(+)} lead 318 connected to input terminal 108. Slider card 152 is in a third position, in which jumper 155 electrically couples electrical contact 119 to electrical contact 120. The signal at input terminal 105 is supplied to the first speaker 306 via input conductor 114, electrical contact 118, output conductor 122, output terminal 110, and negative lead 310. The signal transits first speaker 306 and is supplied to second speaker 308 via positive lead 311, output terminal 112, output conductor 124, electrical contact 120, jumper 155, electrical contact 119, output conductor 123, output terminal 111, and negative lead 312. The circuit is completed back to amplifier 307 via positive lead 313, output terminal 113, output conductor 125, electrical contact 121, input conductor 117, input terminal 108, and lead 318. In this configuration, one amplifier 307 drives first speaker 306 and second speaker 308 in series. Upon reading the teachings of this specification, those with ordinary skill in the art will now understand that, under appropriate circumstances, considering such issues as advances in technology, user preference, material costs, needs for a circuit, etc., reverse operation using two supply circuits in series driving a single load, additional similar circuitry to accommodate additional speakers 306 and 308 in series, etc., may suffice.

FIGS. 3A-3C, taken as a whole, illustrate and define an operational relationship between the terminal base 102 and the slider card 152. By repositioning the slider card 152 over the terminal base 102, the mechanically coupled jumpers 155-157 that engage, or do not engage, electrical contacts 118-121 produce the various configurations for bi-amplifier, parallel, and series output to the first and second speakers 306 and 308. The operational relationship is enabled by support from housing 400 (See FIGS. 4A and 4B) which may support the terminal base 102 in a substantially fixed position and may support the slider card 152 in a moveable position in relation to the terminal base 102 using tab support 210, tab constraint 212, slider support 214, and slider constraint 216. In a particular embodiment, the relative motion between the slider card 152 and the terminal base 102 may be reversed, with the slider card 152 supported in place while the terminal base repositions.

Figure 4A:
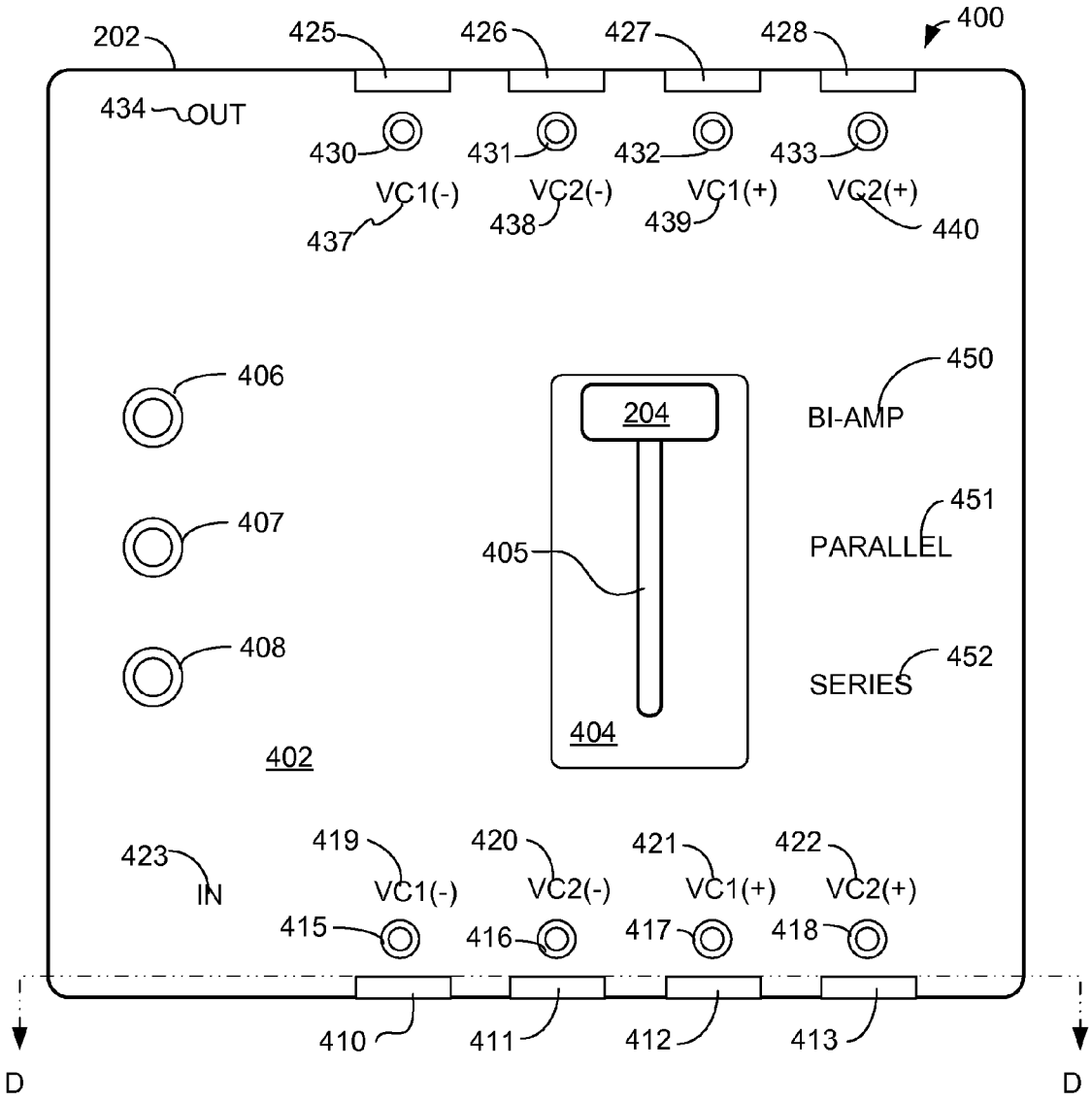
FIG. 4A is a top plan view illustrating an exemplary embodiment of a housing of the exemplary embodiment of the adjustable terminal block of FIGS. 2A-2C showing cross section DD.
Figure 4B:
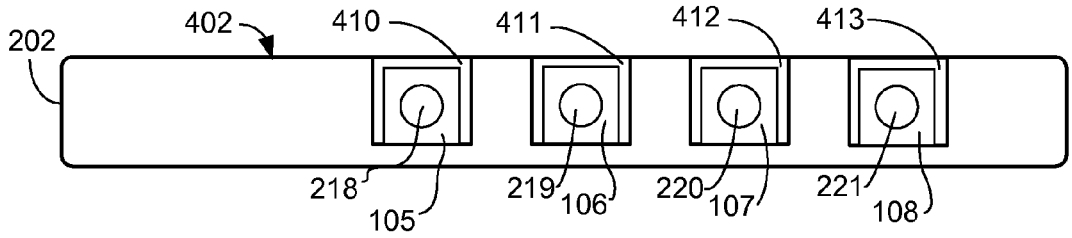
FIG. 4B is cross-sectional view through section DD of FIG. 4A illustrating an exemplary embodiment of the adjustable terminal block of FIG. 4A.

FIG. 4A is a top plan view illustrating an exemplary embodiment of a housing 400 of the exemplary embodiment of the adjustable terminal block 200 of FIGS. 2A-2C and defining cross section DD. Front face 402 of housing 400 is delimited by housing perimeter 202. Housing front face 402 includes détentes 425, 426, 427, and 428 for access to output terminal 110-113 and détentes 410, 411, 412, and 413 for access to input terminals 105-108. Housing 400 also includes fastener ports 406, 407, and 408 aligned to fastening adaptations 211, 217, and 213, respectively, for inserting a fastener to fasten tab 160 and thereby, slider card 152 in a desired configuration. Setscrew ports 415, 416, 417, and 418 in housing 400 are aligned to the setscrew holes (such as 104) in input terminals 105-108, respectively. Setscrew ports 430, 431, 432, and 433 in housing 400 are aligned to the setscrew holes (such as 109) in output terminals 110-113, respectively. Housing 400 may include a depression 404 around slot 405. Slot 405 accommodates support 206 for slider handle 204. Depression 404 assists in maintaining slider handle 204 below or at the level of front face 402 generally, and thereby reduces the size of the space needed for installation. Upon reading the teachings of this specification, those with ordinary skill in the art will now understand that, under appropriate circumstances, considering such issues as advances in technology, user preference, material costs, ergonomics, etc., various designs for housing 400, such as those adapted to various shapes of cavities available in various installations, various ergonomic surface topographies, and various designs for providing access to input terminals 105-108 and output terminals 110-113 etc., may suffice Label 423 indicates, generally, which end of the housing has the input terminals 105-108. Label 424 indicates, generally, which end of the housing has the output terminals 110-113. Input labels 419, 420, 421, and 422 indicate to the installer which of the leads from the amplifier to connect to which input terminals 105-108. Slider labels 450, 451, and 452 indicate the proper position of the slider handle 240 corresponding to the desired configuration. Output labels 437, 438, 439, and 440 indicate to the installer which of the leads from the first and second speakers 306 and 308 to connect to which of the output terminals 110-113. The various labels 423, 424, 419-422, 437-440, and 450-452 may be embossed, painted, windowed, stenciled, decaled, or otherwise affixed or built into the housing 400. Upon reading the teachings of this specification, those with ordinary skill in the art will now understand that, under appropriate circumstances, considering such issues as advances in technology, user preference, material costs, ergonomics, etc., various approaches to providing indicators, such as indicator lights, tactile indicators, remote indicators, etc., may suffice FIG. 4B is cross-sectional view through section DD of FIG. 4A illustrating an exemplary embodiment of the adjustable terminal block 200 of FIG. 4A. The détentes 410, 411, 412, and 413 enable access to the input terminals 105-108 with minimum exposure of the input terminals 105-108 to the environment. The housing 400 is preferably dust resistant, flame resistant, and water resistant. The housing 400 is preferably of two-piece construction for ease of production. Upon reading the teachings of this specification, those with ordinary skill in the art will now understand that, under appropriate circumstances, considering such issues as advances in technology, user preference, material costs, ergonomics, production costs, environmental factors, etc., various materials for the housing 400, such as plastic, ceramic, metal, or even wood, etc., may suffice While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. An adjustable terminal, manually adjustable to select one particular electrical coupling from among at least three possible electrical couplings of leads from at least one amplifier to leads going to at least two speakers, said adjustable terminal comprising:

a. at least one terminal base, further comprising:
   i. at least four input terminals;
   ii. at least four output terminals each electrically coupled to only one input terminal of said at least four input terminals;
   iii. at least four electrical contacts each electrically coupled between only one input terminal of said at least four input terminals and only one output terminal of said at least four output terminals; and b. a plurality of mechanically coupled jumpers, wherein each jumper of said plurality of mechanically coupled jumpers is operable to connect at least two electrical contacts of said at least four electrical contacts, c. wherein said plurality of mechanically coupled jumpers is manually operable to be moved to various positions, each position of said various positions corresponding to one of various particular relationships between said plurality of jumpers and said at least four electrical contacts and further corresponding to one of various particular electrical couplings between said at least four input terminals and said at least four output terminals.

2. The adjustable terminal of claim 1, further comprising at least one fastener adaptation operable to assist in fastening said plurality of mechanically coupled jumpers against manual operation.

3. The adjustable terminal of claim 2, wherein said at least one fastener adaptation comprises at least three fastener adaptations, each fastener adaptation operable to assist in fastening said plurality of mechanically coupled jumpers in one position of said various positions.

4. The adjustable terminal of claim 1, further comprising:

a. at least one slider card supporting and mechanically coupling said plurality of mechanically coupled jumpers; and b. at least one housing supporting said at least one terminal base and further supporting said at least one slider card in at least one operational relationship with said at least one terminal base.

5. The adjustable terminal of claim 4, wherein said at least one housing comprises at least one label.

6. The adjustable terminal of claim 5, wherein said at least one label comprises a plurality of labels, each indicating variously an input terminal, an output terminal, and a slider card position.

7. The adjustable terminal of claim 1, a. configurable in at least one bi-amplifier configuration for coupling first and second amplifiers to first and second speakers, respectively, b. wherein said at least four input terminals are operable to pair-wise receive first and second audio signals from said first and second amplifiers, respectively; and c. wherein said plurality of mechanically coupled jumpers is operable to be positioned to supply said first audio signal to at least one first pair of output terminals of said at least four output terminals, said at least one first pair of output terminals operable to supply said first audio signal to said first speaker; and d. wherein said plurality of mechanically coupled jumpers are concurrently operable to supply said second audio signal to at least one second pair of output terminals of said at least four output terminals, said at least one second pair of said at least four output terminals operable to supply said second audio signal to said second speaker.

8. The adjustable terminal of claim 1, a. configurable in at least one parallel configuration to couple exactly one amplifier to first and second speakers in parallel;

b. wherein two of said at least four input terminals are adapted to receive an audio signal from said exactly one amplifier;

c. wherein said plurality of mechanically coupled jumpers is operable to produce output of said audio signal to two pairs of said at least four output terminals; and d. wherein said two pairs of output terminals are operable to supply said audio signal to said first and second speakers in parallel.

9. The adjustable terminal of claim 1, a. configurable in at least one series configuration to couple exactly one amplifier to first and second speakers in series;

b. wherein two of said at least four input terminals are adapted to receive an audio signal from said exactly one amplifier; and c. wherein said plurality of mechanically coupled jumpers is operable to produce output of said audio signal to at least one first pair of said at least four output terminals; and d. wherein said plurality of mechanically coupled jumpers is concurrently operable to couple said first and second speakers in series through at least one second pair of said at least four output terminals.

10. An adjustable terminal comprising:

a. at least one housing;

b. at least one terminal base having at least four input terminals coupled one-to-one to at least four output terminals and further coupled one-to-one to at least four electrical contacts and supported in said at least one housing;

c. at least one slider card mechanically coupling at least one plurality of jumpers and supported in said at least one housing in operational relationship to said at least one terminal base, wherein said at least one slider card is operable to configure said adjustable terminal variously for one of three electrically distinct circuit configurations.

11. The adjustable terminal of claim 10, wherein said at least one slider card is operable to configure said adjustable terminal variously for bi-amplifier output, parallel output, and series output.

12. The adjustable terminal of claim 10, wherein said at least one slider card is fastenable to said at least one housing.

13. The adjustable terminal of claim 10, wherein said at least one housing comprises at least one label.

14. The adjustable terminal of claim 10, wherein said at least one plurality of jumpers are sized, shaped, and arranged to jump at least two electrical contacts of said at least four electrical contacts.

15. An adjustable terminal comprising:

a. a plurality of electrical contacts electrically coupled between a corresponding number of pair-wise electrically-coupled input and output terminals; and b. a plurality of mechanically coupled jumpers operable to connect or disconnect particular electrical contacts of said plurality of electrical contacts to variously provide bi-amplifier output, parallel output, and series output at said output terminals.

16. The adjustable terminal of claim 15, wherein operation of said plurality of mechanically coupled jumpers comprises translational motion relative to said plurality of electrical contacts.

17. The adjustable terminal of claim 15, further comprising at least one housing sized, shaped, and arranged to support said plurality of mechanically coupled jumpers and said plurality of electrical contacts in operational relationship.

18. The adjustable terminal of claim 17, wherein said housing comprises labels indicating the configuration of said adjustable terminal.

19. The adjustable terminal of claim 17, wherein said housing comprises labels indicating said input terminal and said output terminals.

20. The adjustable terminal of claim 15, further comprising at least one fastener adaptation structured and arranged to assist in fastening said plurality of mechanically coupled jumpers in at least one particular relationship with said plurality of electrical contacts.

* * * * *